US009133414B2

(12) United States Patent
Bouffet

(10) Patent No.: US 9,133,414 B2
(45) Date of Patent: Sep. 15, 2015

(54) LUBRICATING COMPOSITIONS FOR TRANSMISSIONS

(75) Inventor: Alain Bouffet, Taluyers (FR)

(73) Assignee: Total Marketing Services, Puteaux (FR)

( * ) Notice: Subject to any disclaimer, the term of this patent is extended or adjusted under 35 U.S.C. 154(b) by 486 days.

(21) Appl. No.: 12/808,527

(22) PCT Filed: Dec. 18, 2008

(86) PCT No.: PCT/FR2008/001778

§ 371 (c)(1),
(2), (4) Date: Jun. 16, 2010

(87) PCT Pub. No.: WO2009/103897

PCT Pub. Date: Aug. 27, 2009

(65) Prior Publication Data

US 2011/0003724 A1 Jan. 6, 2011

(30) Foreign Application Priority Data

Dec. 21, 2007 (FR) ..... 07 09017

(51) Int. Cl.
*C10M 169/04* (2006.01)
*C10M 135/22* (2006.01)
*C10M 141/10* (2006.01)

(52) U.S. Cl.
CPC ..... *C10M 169/04* (2013.01); *C10M 141/10* (2013.01); *C10M 2205/026* (2013.01); *C10M 2207/2825* (2013.01); *C10M 2209/084* (2013.01); *C10M 2219/022* (2013.01); *C10M 2223/04* (2013.01); *C10M 2223/045* (2013.01); *C10M 2223/06* (2013.01); *C10N 2230/02* (2013.01); *C10N 2230/06* (2013.01); *C10N 2240/04* (2013.01)

(58) Field of Classification Search
USPC ..... 508/322, 438, 569
See application file for complete search history.

(56) References Cited

U.S. PATENT DOCUMENTS

| | | | | |
|---|---|---|---|---|
| 4,344,854 | A | 8/1982 | Davis et al. | |
| 4,876,389 | A | 10/1989 | Gongora et al. | |
| 5,135,670 | A | 8/1992 | Johnson et al. | |
| 5,152,908 | A * | 10/1992 | Tipton | 508/186 |
| 5,225,093 | A * | 7/1993 | Campbell et al. | 508/287 |
| 5,942,470 | A | 8/1999 | Norman et al. | |
| 6,472,354 | B2 * | 10/2002 | Luyendijk et al. | 508/324 |
| 6,544,963 | B2 | 4/2003 | Soe et al. | |
| 6,642,187 | B1 * | 11/2003 | Schwind et al. | 508/186 |

FOREIGN PATENT DOCUMENTS

| | | | |
|---|---|---|---|
| EP | 0342454 | A1 | 11/1989 |
| EP | 0695798 | A2 | 2/1996 |
| EP | 1149813 | A1 | 10/2001 |
| FR | 2607496 | A1 | 6/1988 |
| FR | 2630104 | A1 | 10/1989 |
| WO | 9714770 | A1 | 4/1997 |

* cited by examiner

*Primary Examiner* — James Goloboy
(74) *Attorney, Agent, or Firm* — Marsh, Fischmann & Breyfogle LLP

(57) ABSTRACT

The invention relates to a method for improving properties of protection against spalling of transmission lubricating compositions containing sulphur-containing and sulfur-phosphorous compounds comprising a step for adding into the initial transmission lubricating composition, compounds (c) reducing by at least 5% the active sulfur mass content, as measured by the ASTM D1662 standard, in the final composition.

The invention also aims at a lubricating composition comprising:

(a) from 60 to 90% by weight of one or more base oils, of mineral, synthetic or natural origin, (b) at least one anti-wear and extreme pressure phosphorous or sulfur-phosphorous additive, (c) at least one anti-wear and extreme pressure sulfur-containing additive, wherein:

the ratio between the elementary sulfur mass content, as measured according to the ASTM D2622 standard, and the elementary phosphorus mass content, as measured according to the ASTM D5185 standard, S/P, of said lubricating composition, is comprised between 20 and 40, preferably between 25 and 35;

the ratio between the active sulfur mass content at 150° C., as measured according to the ASTM D1662 standard, and the elementary sulfur mass content, as measured according to the ASTM D5185 standard, Sactive/S, of said lubricating composition, is less than 0.34, preferentially less than 0.33.

12 Claims, No Drawings

LUBRICATING COMPOSITIONS FOR TRANSMISSIONS

FIELD OF THE INVENTION

The present invention relates to lubricant compositions for transmissions in the field of automobile vehicles, more particularly suitable for lubrication of axles, having the property of increasing fatigue resistance of axle gears.

TECHNOLOGICAL BACKGROUND OF THE INVENTION

A typical cause of damage to axle gears is damaging by fatigue, which occurs under repeated efforts. This phenomenon is induced by repeated rolling stresses under strong loads.

This is expressed by pitting (surface fatigue) or spalling (deep fatigue) phenomena. Spalling occurs after a long aging time, preceding visible deteriorations. The mechanisms are badly known, but the phenomenon starts by initiation of cracks at a certain depth under the surface, these cracks propagate, and when cracks normal to the surface are created, spalls are suddenly detached therefrom.

The spalling phenomenon is particularly sensitive on axles of heavy trucks, where the gears are subject to very strong loads and to very long periods of use.

Preventing this phenomenon goes through a reduction of the contact stresses by means of a suitable geometry of the parts, and through reduction of friction, while avoiding adhesion.

The lubricant is involved in this prevention process because of its viscosity and the physico-chemical reactivity of its additives.

Sulfur additives, as well as phosphorous and sulfur-phosphorous additives are widely used in the formulations of oil for axles and gear boxes, as anti-wear and extreme pressure additives. They protect frictional parts under a strong load by forming a film adsorbed on their surface.

Sulfur additives, forming a tribo-film of iron sulfide with a low shear resistance, easily detachable, notably allow prevention of seizing-up, a phenomenon which occurs right from the first stages of use, when the resistance of the interface exceeds that of the underlying material.

The additives present in the lubricant may also have an either positive or negative impact, on the propagation of cracks inside the parts and therefore on the spalling phenomenon.

There is therefore a need for increasing the life time of frictional parts, notably of axle gears, while limiting the occurrence of the spalling phenomenon.

SUMMARY OF THE INVENTION

For this purpose, the present invention proposes a method for improving properties for protection against spalling of transmission lubricating compositions containing sulfur and sulfur-phosphorous compounds, comprising a step for adding into the initial transmission lubricating composition, compounds (c) reducing by at least 5% the active sulfur mass content, as measured by the ASTM D1662 standard, in the final composition.

Preferably, in the method according to the invention, the ratio between the final sulfur mass content Sfinal in the final composition, after applying the method, and the initial sulfur mass content Sinitial in the initial composition, before applying the method, a mass content, as measured according to the ASTM D2622 standard, Sfinal/Sinitial is larger than or equal to 1.05.

Preferably, in the method according to the invention, the added compound (c) is a sulfur-containing additive in which:

- the ratio between the active sulfur mass content at 150° C., as measured according to the ASTM D1662 standard, and the elementary sulfur mass content, as measured according to the ASTM D5185 standard, Sactive/S, is less than 0.45 and,
- the elementary sulfur mass content, as measured according to the ASTM D5185 standard, is larger than 20%, preferentially larger than 40%.

Preferably, in the method according to the invention, the additive (c) is selected from one or more sulfurized olefins fitting the general formula R1-Sx-R2, wherein R1 and R2 are alkyl groups including from 3 to 15 carbon atoms, preferentially from 1 to 5 carbon atoms, preferentially 3 carbon atoms, and x is an integer comprised between 2 and 6, preferentially equal to 3.

Preferably, in the method according to the invention, the final lubricating composition comprises:

(a) from 60 to 90% by weight of one or more base oils, of mineral, synthetic or natural origin, (b) at least one anti-wear and extreme pressure phosphorous or sulfur-phosphorous additive, (c) at least one anti-wear and extreme pressure sulfur-containing additive, wherein:

- the ratio between the elementary sulfur mass content, as measured according to the ASTM D2622 standard, and the elementary phosphorus mass content, as measured according to the ASTM D5185, of said lubricating composition, is comprised between 20 and 40, preferably between 25 and 35;
- the ratio between the active sulfur mass content at 150° C., as measured according to the ASTM D1662 standard, and the elementary sulfur mass content, as measured according to the ASTM D5185 standard, Sactive/S, of said lubricating composition, is less than 0.34, preferentially less than 0.33.

According to another object, the invention relates to a lubricating composition comprising:

(a) from 60 to 90% by weight of one or more base oils, of mineral, synthetic or natural origin, (b) at least one anti-wear and extreme pressure phosphorous or sulfur-phosphorous additive, (c) at least one anti-wear and extreme pressure sulfur-containing additive, wherein:

- the ratio between the elementary sulfur mass content, as measured according to the ASTM D2622 standard, and the elementary phosphorus mass content, as measured according to the ASTM D5185 content, S/P, of said lubricating composition, is comprised between 20 and 40, preferably between 25 and 35;
- the ratio between the active sulfur mass content at 150° C., as measured according to the ASTM D1662 standard, and the elementary sulfur mass content, as measured according to the ASTM D5185 standard, Sactive/S, of said lubricating composition, is less than 0.34, preferentially less than 0,33.

Preferably, in the composition according to the invention, the active sulfur mass content at 150° C., Sactive, as measured according to the ASTM D1662 standard, is less than or equal to 1.200%, preferentially less than or equal to 1.180%.

Preferably, the lubricating composition according to the invention contains from 0.1 to 2% by weight of at least one sulfur-containing additive (c) wherein:

the ratio between the active sulfur mass content at 150° C., as measured according to the ASTM D1662 standard, and the elementary sulfur mass content, as measured according to the ASTM D5185 standard, Sactive/S, is less than 0.45 and, the elementary sulfur mass content, as measured according to the ASTM D5185 standard, is larger than 20%, preferentially larger than 40%.

Preferably, in the composition according to the invention, the additive (c) is selected from one or more sulfurized olefins fitting the general formula R1-Sx-R2, wherein R1 and R2 are alkyl groups including from 3 to 15 carbon atoms, preferentially from 1 to 5 carbon atoms, preferentially 3 carbon atoms, and x is an integer comprised 2 and 6, preferentially equal to 3.

Preferably, the lubricating composition according to the invention comprises, as a base oil (a), from 10 to 20% of one or more base oils of the Group V, in a possible combination with one or more base oils selected from the Groups I, II, III, IV or VI of the API classification, and/or base oils of natural origin.

Preferably, in the composition according to the invention, the 60 to 90% of base oil (a) are made up from:

20 to 30% by weight relatively to the total weight of the lubricant, of a paraffinic base oil of high viscosity, belonging to the Group I of the API classification, with a viscosity comprised between 30 and 34 cSt at 100° C. (25.5% BSS)

30 to 45% by weight, relatively to the total weight of lubricant, of a paraffinic base oil of Group I with a viscosity comprised between 10 and 15 cSt at 100° C. (40.35% 600NS)

10 to 20% by weight, relatively to the total weight of lubricant, of a synthetic oil of Group V.

Preferably, in the composition according to the invention, the anti-wear and extreme pressure phosphorous or sulfur-phosphorous additive(s) (b) are selected from alkyl phosphates, alkyl phosphonate, thiophosphoric acid, thiophosphorous acid, esters of these acids, their salts, alkyl dithiophosphates.

Preferably, the composition according to the invention, has a Brookfield dynamic viscosity less than or equal to 150 mPa at temperatures above or equal to −12° C., preferentially above or equal to −26° C., preferentially above or equal to −40° C.

Preferably, the composition according to the invention has a kinematic viscosity at 100° C. below or equal to 32.5 cSt.

Preferably, the composition according to the invention, belongs to the class of multigrade oils of grade 85W140, 85W90, 80W90, or 75W90 or monograde oils of grade 140 or 90 according to the SAEJ306 standard.

According to another object, the invention is also directed to the use of a lubricating composition according to the invention as a lubricant for transmissions of vehicles, preferentially as a lubricant for gears of axles of vehicles.

Preferably, a lubricating composition according to the invention is used as a lubricant for increasing the resistance to spalling of metal frictional parts, preferentially gears of axles of vehicles.

According to another object, the invention is also directed to the use of sulfur-containing olefins either alone or as a mixture for reducing by at least 5% the active sulfur mass content as measured by the ASTM D1662 standard of a lubricating composition for transmission, said sulfurized olefins being represented by the general formula R1-Sx-R2, wherein R1 and R2 are alkyl groups including from 3 to 15 carbon atoms, preferentially from 1 to 5 carbon atoms, preferentially 3 carbon atoms, and x is an integer comprised between 2 and 6, preferentially equal to 3 and wherein the ratio between the active sulfur mass content at 150° C., as measured according to the ASTM D1662 standard, and the elementary sulfur mass content, as measured according to the ASTM D5185 standard, Sactive/S, is less than 0.45 and the elementary sulfur mass content, as measured according to the ASTM D5185 standard, is larger than 20%, preferentially larger than 40%, According to a preferred embodiment, one or more of said sulfurized olefins are used, accounting for 0.1 to 2% by mass of the final transmission lubricating composition.

Surprisingly, the applicant noticed that it was possible to improve the properties of protection against spalling of oil formulations for axles containing customary sulphur-phosphorous and/or phosphorous compounds, by adding certain compounds which lower by at least 5%, preferably by at least from 8 to 20%, the active sulfur content of said formulations.

This is all the more surprising since these compounds may themselves contain sulfur and active sulfur. Without having the intention of being bound to any theory, these compounds seem to <<absorb>> or <<stabilize>> a part of the active sulfur initially present in the lubricating compositions before treatment.

The object of the present invention is also lubricating compositions with which the life time of frictional parts may be increased, notably gears of axles, by limiting the occurrence of the spalling phenomenon.

Surprisingly, the applicant noticed that certain transmission oils having a specific ratio between their elementary sulfur mass content and elementary phosphorus mass content, S/P, as well as their active sulfur and sulfur mass content, Sactive/S, allow a considerable increase (up to doubling) of the life time of the parts.

Here the active sulfur content of a compound or a lubricating composition designates the sulfur consumed for forming copper sulfide upon adding copper powder at 150° C. in said compound or said lubricating composition. The active sulfur mass % is as measured by the ASTM1662 standard.

Thus, these properties for improving resistance to spalling may for example be obtained by introducing certain sulfurized olefins of the dialkyl sulfide type, in an axle oil formula containing customary sulfur-phosphorous and/or phosphorous compounds and optionally customary sulfur-containing additives.

DETAILED DISCUSSION OF EMBODIMENTS OF THE INVENTION

Base Oils:

The base oils according to the invention may be of mineral, synthetic or natural origin.

Mineral base oils according to the invention include all types of bases obtained by atmospheric and in vacuo distillation of crude petroleum, followed by refining operations such as extraction by a solvent, deasphalting, dewaxing with a solvent, hydrotreating, hydrocracking and hydro-isomerization, hydrofinishing, . . .

The preferred mineral base oils are the oils of Group I according to the API classification, obtained by extraction with a solvent and dewaxing with a solvent of an atmospheric residue, of deasphalted oil, . . .

In particular, lubricating compositions according to the present invention advantageously include from 20 to 30% by weight of a paraffinic base oil with strong viscosity of Group I according to the API classification, with a viscosity comprised between 30 and 34 cSt at 100° C. and from 30 to 45% by weight of a Group I paraffinic base oil with viscosity comprised between 10 and 15 cSt at 100° C.

The synthetic base oils according to the present invention are oils belonging to the Groups IV, V and VI of the API classification, including polyalphaolefins, polyinternal olefins, alkyl-aromatic compounds, alkyl benzene, alkyl naphthalenes, esters, diesters, polyol esters such as pentaerythritol esters, oligomers of alphaolefins and of esters, polyalkylene glycols.

In particular, the lubricating compositions according to the present invention advantageously include from 10 to 20% by weight of a Group V synthetic base oil, in particular bases of the ester type, in an optional combination with one or more base oils selected from Groups I, II, III, IV or VI of the API classification, and/or base oils of natural origin.

The preferred synthetic base oils of Group V are diesters such as ditridecyl glutarate, di-2-ethylhexyl adipate, di-isodecyl adipate, ditridecyl adipate, di-2-ethyhexyl sebacate.

Thus, the lubricating compositions according to the present invention may advantageously comprise:

- 20 to 30% by weight, relatively to the total weight of lubricant, of a paraffinic base oil of strong viscosity, belonging to Group I of the API classification, with a viscosity comprised between 30 and 34 cSt at 100° C. (25.5% BSS)
- 30 to 45% by weight, relatively to the total weight of lubricant, of a Group I paraffinic base oil with a viscosity comprised between 10 and 15 cSt at 100° C. (40.35% 600NS)
- 10 to 20% by weight, relatively to the total weight of lubricant, of a Group V synthetic oil, for example a base oil of the ester type.

Anti-wear and Extreme Pressure Additives:

The anti-wear and extreme pressure sulfur-phosphorous additives used in the present invention for example and in a non-limiting way, are thiophosphoric acid, thiophosphorous acid, esters of these acids, their salts, and dithiophosphates, particularly zinc dithiophosphates.

As examples of anti-wear and extreme pressure sulfur-phosphorous additives, mention may be made of those which include from 1 to 3 sulfur atoms, such as monobutyl thiophosphate, monooctyl thiophosphate, monolauryl thiophosphate, dibutyl thiophosphate, dilauryl thiophosphate, tributyl thiophosphate, trioctyl thiophosphate, triphenyl thiophosphate, trilauryl thiophosphate, monobutyl thiophosphite, monooctyl thiophosphite, monolauryl thiophosphite, dibutyl thiophosphite, dilauryl thiophosphite, tributyl thiophosphite, trioctyl thiophosphite, triphenyl thiophosphite, trilauryl thiophosphite and their salts.

Examples of salts of esters of thiophosphoric acid and of thiophosphorous acid are those obtained by reaction with a nitrogen-containing compound such as ammonia or an amine or with zinc oxide or zinc chloride.

The lubricating compositions according to the present invention may also contain anti-wear and extreme pressure phosphorous additives, such as for example alkyl phosphates or alkyl phosphonates, phosphoric acid, phosphorous acid, mono-, di-, and tri-esters of phosphorous acid and of phosphoric acid, and their salts.

As an example of anti-wear and extreme pressure sulfur-containing additives, mention may be made of dithiocarbamates, thiadiazoles and benzothiazoles, sulphur-containing olefins.

The most current sulfur-containing olefins are further called SIBs, for <<Sulfurized IsoButylenes>>.

These sulfurized olefins are generally obtained by a sulfurization reaction of olefins by sulfur, by hydrated hydrogen sulfide or alkaline metal sulfides, for example sodium sulfide. An example of methods for preparing such sulfurized olefins is described for example in patents U.S. Pat. Nos. 4,344,854 and 5,135,670.

A very wide range of olefins may thus be sulfurized. Preferentially, sulfurized olefins are made from isobutylene, diisobutylene, triisobutylene, tripropylene, or tetrapropylene.

The thereby produced SIBs are mixtures of compounds with a poorly defined structure, including i.a. impurities, trithiones, dithiolethiones and halogens, and with high active sulphur content.

Sulfurized Olefins Used in the Invention:

The sulfurized olefins used in the compositions according to the present invention are dialkyl sulfides represented by the formula R1-Sx-R2, where R1 and R2 are alkyl groups including a number of carbon atoms comprised between 3 and 15, and wherein x is an integer comprised between 2 and 6.

The average size of the alkyl groups R1 and R2 may be obtained by NMR analysis. It may be also directly deduced from the nature of the olefins used as a starting material.

The sulfur mass content of these products, as measured by the ASTM D 2622 standard, then enables the value of x to be calculated.

These products are also characterized by their active sulfur mass content, i.e. the sulfur released when the product is put in the presence of copper. The amount of formed copper sulfide is then measured. The free sulfur content at 150° C. is as measured according to the ASTM D-1662 standard.

The alkyl components of the dialkyl sulfides according to the invention include from 3 to 15 carbon atoms, preferentially from 3 to 12 carbon atoms.

Among the dialkyl sulfides according to the invention, short chain compounds (average number of carbon atoms comprised between 3 and 5, preferentially equal to 4) will be advantageously selected.

Dialkyl trisulfides (x=3) will be preferred.

The sulfurized olefins according to the invention preferentially have a strong elementary sulfur content (larger than 20%, preferentially larger than 40%) and are compounds in which the ratio between the active sulfur mass content at 150° C., as measured according to the ASTM D1662 standard, and the elementary sulfur mass content as measured according to the ASTM D5185 standard, Sactive/S, is less than 0.45.

These specific sulfurized olefins which are distinguished from the SIBs described above or those in patents U.S. Pat. Nos. 4,344,854 and 5,135,670 are for example obtained by reaction of hydrogen sulfide with isobutylene in the presence of a catalyst.

Typically, the sulfurized olefins used in the invention are obtained from isobutylene, from sulfur and hydrogen sulfide, by catalytic methods using solid catalysts such as those described in the patents EP 1149813, U.S. Pat. No. 6,544,963, or further by methods as described in the patents FR 2 607 496 and FR 2 630 104, consisting of reacting a mercaptan and sulfur in the presence of a basic catalyst. They may also be produced by a method in two steps, as described in patent EP 342 454, consisting of synthesizing, in a first phase, a mercaptan from an olefin and from $H_2S$ in the presence of a solid catalyst, and then by putting said mercaptan in the presence of sulfur and another heterogeneous catalyst in order to form the sulfurized olefin.

These methods lead to very pure products, with a better defined structure, with higher sulfur content and generally lower active sulfur content than the SIBs currently used.

The sulfurized olefins mentioned above may also be advantageously used in combination with standard SIBs as described above.

In transmission lubricating compositions, the sulfur content of the base oil or of the base oil mixture, as well as the respective amounts of extreme pressure sulphur-phosphorous, phosphorous, and sulfur-containing additives, notably sulfurized olefins, are generally selected so that said compositions have a ratio between their elementary sulfur content, as measured by the ASTM D4294 standard and their elementary phosphorus content, as measured by the ASTM D5185 standard, i.e. S/P, is comprised between 10 and 60. The lubricating compositions according to the present invention have an S/P ratio preferentially comprised between 20 and 40, preferentially comprised between 25 and 35.

The present invention also relates to the use of the specific sulfurized olefins described above for preparing lubricating compositions improving resistance to spalling of frictional parts.

These compounds are also applied in the method according to the invention, for improving properties of protection against spalling of lubricating compositions containing sulfur-containing and sulfur-phosphorous additives.

Other compounds provide the lubricating compositions with improved properties of protection against spalling:

In addition to the specific sulfurized olefins described above for improving the properties of protection against spalling of lubricating compositions containing sulphur-containing and sulfur-phosphorous additives, compounds may be added such as unsaturated natural fats, for example oleic acid, linoleic acid, stearic acid or else natural oils containing these unsaturated natural fats alone or as a mixture, such as for example rapeseed, sunflower, palm, coprah, coconut oil, flax oil or castor oil . . . or else olefins such as for example, isobutylene, hexene, nonene, decene, dodecene, tetradecene, styrene, . . . These compounds can be used alone or in mixture thereof, or optionally combined with the specific sulfurized olefins described above, in the process according to the invention for improving anti-spalling properties of compositions for transmission containing sulphur and phosphosulfur compounds.

Preferentially, the nature and the amount of these additives are selected so that the final composition after applying the method has the following characteristics:

- a ratio between the elementary sulfur mass content, as measured according to the ASTM D2622 standard, and the elementary phosphorous mass content, as measured according to the ASTM D5185 standard, S/P, of said lubricating composition, is comprised between 20 and 40, preferably between 25 and 35, and
- a ratio between the active sulfur mass content at 150° C., as measured according to the ASTM D1662 standard, and the elementary sulfur mass content, as measured according to the ASTM D5185 standard, Sactive/S, of said lubricating composition, is less than 0.33.

Other Additives:

The lubricating compositions according to the present invention may also contain all types of additives adapted to their use.

Preferably, the total weight % of sulfur-phosphorous, phosphorous and sulfur-containing additives is comprised between 10 and 30%.

Thickeners:

In particular, the compositions according to the invention may contain one or more thickening additives, the role of which is to increase both hot and cold viscosity of the composition, or additives improving the viscosity index (VI).

These additives are the most often polymers of low molecular weight, of the order of 2,000-50,000 Daltons (Mn).

They will preferably be present in an amount from 1 to 10% by weight in the compositions according to the invention.

They may be selected from PIBs (of the order of 2,000 Daltons), polyacrylates or polymethacrylates (of the order of 30,0000 Daltons), olefin-copolymers, copolymers of olefin and alpha olefins, EPDM, polybutenes, poly-alphaolefins of high molecular weight (viscosity at 100° C.>150), styrene-olefin copolymers, either hydrogenated or not . . .

Flow Point Lowering Agent:

The compositions according to the invention may contain one or more additives, and a flow point lowering additive.

These additives may typically be present in an amount from 0.1 to 2% by weight. These may be for example polyacrylates, ethyl-vinyl acetates, ethylenic copolymers, naphthalene condensation derivatives . . . , anti-corrosion agents and copper passivating agents, for example such as polyisobutene succinic anhydrides, sulfonates, thiadiazole, mercaptobenzothiazole.

The oils according to the invention may also contain all types of additives adapted to their use, and notably:

- detergents such as for example sulfonates, phenates, salicylates of calcium, sodium, magnesium, barium, . . .
- dispersants such as derivatives of polyisobutylene succinic anhydride, . . .
- antioxidants, which may for example be amine antioxidants (octadiphenylamines, phenyl-alpha-naphthylamines, . . . ), phenolic antioxidants (BHT and derivatives), sulfur-containing antioxidants (sulfurized phenates), . . .

The viscosity of the oils according to the invention may be defined by their grade according to the SAE J306 standard. The values of the viscosities corresponding to the different grades are reported in the Table 1 below.

The kinematic viscosity values at 100° C. are as measured according to the standard:

Brookfield viscosity measurements are conducted according to the standard:

TABLE 1

| | Brookfield 150,000 mPa · s | KV 100° C., cSt | |
|---|---|---|---|
| Grade | max | min | max |
| 70 W | −55° C. | | |
| 75 W | −40° C. | | |
| 80 W | −26° C. | | |
| 85 W | −12° C. | | |
| 80 | | 7 | <11 |
| 85 | | 11 | <13.5 |
| 90 | | 13.5 | <18.5 |
| 110 | | 18.5 | <24 |
| 140 | | 24 | <32.5 |
| 190 | | 32.5 | <41 |
| 250 | | >41 | |

The oils according to the invention preferentially have grades characteristic of axle oil formulas for lightweight or heavy vehicles. Preferentially, they are of grade 75W-90, 80W-90, 85W-90, 85W140, or monograde oils 90 or 140.

EXAMPLES

Of course, the present invention is not limited to the examples and to the embodiment as described and illustrated, but is capable of having many alternatives accessible to one skilled in the art.

The reference lubricating composition (A) is an 80W90 grade oil. This reference as well as the compositions B, C, and D, were prepared from a mixture of several base oils and additives.

The sulfur-phosphorous additives are provided by a performance additive pack for transmission oils, providing the whole of the basic properties (anti-wear, extreme pressure, anti-oxidant, anti-corrosion properties . . . ), and notably containing alkyl dithiophosphates, alkyl phosphonates, alkyl phosphates.

The characteristics of the sulfurized olefins OS1, OS2, OS3, used in Examples B, C and D respectively, are grouped in Table 2.

Table 2

| Description | Dialkyl trisulfide OS1 | Dialkyl pentasulfide OS2 | Dialkyl trisulfide OS3 |
|---|---|---|---|
| Number of carbon atoms of the alkyl components (R1, R2) | C12 | C12 | C4 |
| Sulfur content (mass %) ASTM D2622 | 21.5 | 30.5 | 44 |
| Active sulfur at 150° C. (mass %) ASTM D1662 | 4 | 23 | 18 |
| Kinematic viscosity at 40° C. (KV 40° C.), in cSt | 53 | 164 | 5 |
| PM flash point | 139 | 139 | 114 |
| Flow point | <−20° C. | <−20° C. | <+10° C. |
| S active/S | 0.18 | 0.75 | 0.40 |

The amounts of sulfurized olefins added to the reference for obtaining the oils B, C and D were calculated so that the provision of elementary sulfur is the same as in the 3 examples B, C and D (i.e. a provision of 0.2% by mass of S).

The mass compositions and the main characteristics of the oils A, B, C and D are given in Table 3.

For reference A and oils B, C, and D, the phosphorus (ASTM D5185), sulfur (ASTM D2622) mass content and active sulfur mass content at 150° C. (ASTM D1662) were measured.

The theoretical sulfur and active sulfur contents were also calculated for oils B, C, and D, with knowledge of the content of reference A (initial S, initial Sactive), and the amounts provided by the compounds OS1, OS2, OS3.

TABLE 3

| Formulas | reference A | non-invention C | invention B | invention D |
|---|---|---|---|---|
| Group I viscous base | 25.50 | 25.34 | 25.25 | 25.38 |
| Group I average base | 40.35 | 40.10 | 39.95 | 40.17 |
| Group V synthesis base (ester) | 15.00 | 14.91 | 14.85 | 14.93 |
| Polyisobutene | 5.50 | 5.47 | 5.45 | 5.47 |
| Sulfur-phosphorous additive (Hitec 389) | 13.25 | 13.17 | 13.12 | 13.19 |
| Polyacrylate | 0.40 | 0.40 | 0.40 | 0.40 |
| Dialkyl trisulfide X = 3, C12, OS1, | | | 1.00 | |
| Dialkyl pentasulfide X = 5, C12, 0S2, | | 0.63 | | |
| Dialkyl trisulfide X = 3, C4, 0S3, | | | | 0.46 |
| P (mg/kg) ASTM D5185 measurement | 1184 | 1192 | 1183 | 1212 |
| S (mass %) ASTM D2622 measurement | 3.342 (=Sinitial) | 3.529 (=Sfinal) | 3.519 (=Sfinal) | 3.554 (=Sfinal) |
| Sactive at 150° C. (mass %), ASTM D1662 measurement | 1.307 (=initial Sactive) | 1.245 (=final Sactive) | 1.174 (=final Sactive) | 1.145 (=final Sactive) |
| S/P (measured) | 28.2 | 29.6 | 29.7 | 29.3 |
| Sactive/S (measured) | 0.39 | 0.35 | 0.33 | 0.32 |
| Theoretical S (mass %) | | 3.530 | 3.560 | 3.540 |
| Theoretical Sactive (mass %) | | 1.452 | 1.347 | 1.390 |
| Final Sactive/initial Sactive | | 0.952 | 0.898 | 0.876 |
| S final/Sinitial | | 1.056 | 1.053 | 1.063 |

TABLE 3-continued

| bis. | | |
|---|---|---|
| Nature | Function | Reference A, Mass % |
| Sulfur-phosphorous additive | Performance additive pack | 13.25 |
| Polyisobutene | Synthetic thickener | 5.50 |
| Polyacrylate | Flow point lowering agent | 0.40 |
| Bright Stock Solvent | Viscous base | 25.50 |
| Extracted 600 Neutral Solvents | Average base | 40.35 |
| Di-isodecyl adipate | Synthetic base | 15.00 |

Spalling Resistance Tests:

Spalling resistance tests were carried out on an FZG machine (a machine identical to those used in the standardized DIN 51354 and CEC L07-A-95 tests), under the following operating conditions, adapted to evaluating the spalling phenomenon:

bearing 10

90° C.

Type C gears speed 1,450 rpm measured life time: time period before occurrence of spalls, the total surface of which covers 5mm$^2$ or more on the gear.

The oils A, B, C and D were tested three times. The result is reported as a number of hours required for obtaining a 5% spalled surface in the test. The results of these tests are grouped in Table 4.

The relatively large dispersion of the tests is quite typical of spalling resistance tests, since this kind of wear occurs after a long aging period, preceding visible defects which occur suddenly.

The improvement values observed for the different oils show an absolutely certain improvement for the formulas B and D. However it should be noted that the improvement obtained for oil B corresponds to a single test of significant duration, the two other tests remaining at a moderate improvement value.

The results obtained with oil D are all three at values much larger than those observed with reference A. This formula is therefore more performing in the field of resistance to spalling.

TABLE 4

| formulas | reference A | non-invention C | invention B | invention D |
|---|---|---|---|---|
| Treatment rate, mass % | | 0.63% | 1% | 0.46% |
| Added active sulfur, mass % | | 0.14% | 0.04% | 0.08% |
| Life time in hours | | | | |
| test 1 | 42 | 84 | 56 | 98 |
| Test 2 | 56 | 28 | 126 | 70 |
| Test 3 | 28 | 56 | 56 | 98 |
| Average | 42 | 56 | 79 | 89 |
| Standard deviation | 14 | 28 | 40 | 16 |

Interpretation of the Results:

It is seen that in the range of values of the relevant S/P ratio (comprised between 25 and 35), the life time of the gears observed on the spalling test FZG is strongly correlated with the value of the Sactive/S ratio and with the S active sulfur content (correlation coefficient $R^2$=0.92 and 0.99).

Moreover, it is seen by comparing the theoretical active sulfur contents and those measured for oils B, C, and D, that the measured values are significantly less than the theoretical values.

Addition of the compounds OS1, OS2, OS3 to the reference formula A actually has the effect of lowering the active sulfur content in these formulas, with simultaneous increase in the life time of the gears, observed on the spalling test FZG.

The invention claimed is:

1. A lubricating composition comprising:

(a) from 60 to 90% by weight of one or more base oils, of mineral, synthetic or natural origin, comprising:

-20 to 30% by weight, relative to the total weight of the lubricant composition, of a paraffinic base oil of strong viscosity, belonging to Group I of the API classification, with a viscosity between 30 and 34 cSt at 100° C., -30 to 45% by weight, relative to the total weight of the lubricant composition, of a Group I paraffinic base oil with a viscosity between 10 and 15 cSt at 100° C., and -10 to 20% by weight, relative to the total weight of the lubricant composition, of a Group V synthetic oil, (b) at least one anti-wear and extreme pressure phosphorus or sulfur-phosphorus additive selected from the group consisting of alkyl phosphates, alkyl phosphonate, thiophosphoric acid, thiophosphorus acid, esters of these acids, their salts and alkyl dithiophosphates, (c) from 0.1 to 2% by weight of at least one anti-wear and extreme pressure sulfur-containing additive selected from one or more sulfurized olefins fitting the general formula R1-$S_x$-R2, wherein R1 and R2 are alkyl groups including from 3 to 12 carbon atoms and x is 3, wherein the ratio of the active sulfur mass content at 150° C., as measured according to the ASTM D1662 standard, to the elementary sulfur mass content, as measured according to the ASTM D5185 standard, ($S_{active}$/S) in the sulfur-containing additive is less than 0.45, and wherein the elementary sulfur mass content, as measured according to the ASTM D5185 standard, in the sulfur-containing additive is greater than 20%, and wherein:

the ratio of the elementary sulfur mass content, as measured according to the ASTM D2622 standard, to the elementary phosphorus mass content, as measured according to the ASTM D5185 standard (S/P) in the lubricating composition is between 25 and 35;

the ratio of the active sulfur mass content at 150° C., as measured according to the ASTM D1662 standard, to the elementary sulfur mass content, as measured according to the ASTM D5185 standard ($S_{active}$/S) in the lubricating composition, is less than 0.34; and the total of sulfur-phosphorus, phosphorus and sulfur-containing additives is between 10% and30% by weight in the lubricating composition.

2. The lubricating composition according to claim 1, wherein the active sulfur mass content at 150° C. ($S_{active}$) as measured according to the ASTM D1662 standard, is less than or equal to 1.200%.

3. The lubricating composition according to claim 1, the dynamic Brookfield viscosity of which is less than or equal to 150 mPa at temperatures above or equal to −12° C.

4. The lubricating composition according to claim 1, the kinematic viscosity of which at 100° C. is less than or equal to 32.5 cSt.

5. The lubricating composition according to claim 1, belonging to the class of multigrade oils of grades 85W140, 85W90, 80W90, or 75W90 or monograde oils of grade 140 or 90 according to the SAEJ306 standard.

6. A process for lubricating a vehicle transmission wherein the vehicle transmission is brought into contact with the lubricating composition according to claim 1.

7. A process for increasing resistance to spalling of metal frictional parts, wherein metal frictional parts are brought into contact with the lubricating composition according to claim 1.

8. The lubricating composition according to claim 1, wherein the ratio of said the active sulfur mass content at 150° C., as measured according to the ASTM D1662 standard, to the elementary sulfur mass content, as measured according to the ASTM D5185 standard, ($S_{active}$/S) is less than 0.33.

9. The process according to claim 6, wherein the vehicle transmission comprises axle gears of the vehicle.

10. The process according to claim 7, wherein the metal frictional parts comprise axle gears of a vehicle.

11. The lubricating composition according to claim 1, wherein the total weight % of sulfur-phosphorus, phosphorus and sulfur-containing additives is about 13%.

12. The lubricating composition according to claim 1, wherein the ratio of the elementary sulfur mass content, as measured according to the ASTM D2622 standard, to the elementary phosphorus mass content, as measured according to the ASTM D5185 standard (S/P) in the lubricating composition is comprised between 25 and 29.7.

* * * * *